United States Patent [19]

Siden

[11] 4,015,867

[45] Apr. 5, 1977

[54] DEVICE FOR LATCHING A DOOR IN A PRE-DETERMINED POSITION OR ROTATION

[75] Inventor: Lars Siden, Hudiksvall, Sweden

[73] Assignee: Akustik Miljo AB, Hudiksvall, Sweden

[22] Filed: Apr. 6, 1976

[21] Appl. No.: 674,169

[30] Foreign Application Priority Data

Apr. 9, 1975 Sweden ..... 75040444

[52] U.S. Cl. ..... 292/262; 292/338

[51] Int. Cl.[2] ..... E05C 3/04

[58] Field of Search ..... 292/262, 209, 238, 339, 292/338, 288, 275

[56] References Cited

UNITED STATES PATENTS

| | | | |
|---|---|---|---|
| 885,116 | 4/1908 | Whipple | 292/339 |
| 1,171,908 | 2/1916 | Ware | 292/238 |
| 1,618,348 | 2/1927 | Nicolai | 292/238 X |
| 3,620,483 | 11/1971 | Weinberger | 292/262 |

*Primary Examiner*—Richard E. Moore
*Attorney, Agent, or Firm*—Burns, Doane, Swecker & Mathis

[57] ABSTRACT

A device comprising a securing means and a latching means for latching a door in a pre-determined position of rotation relative to a frame associated with said door when rotating the door in one direction. Means is securely attached to the door and arranged to coact with the door at its upper horizontal edge surface. The latching means extends from the securing means in the form of a horizontally or substantially horizontally extending portion. The securing means and the latching means are pivotally arranged relative to each other and exhibit locking means, which are adapted to co-act with each other so that the latching means is able to adopt one of two position of rotation relative to the securing means. A first position of rotation in which closing of the door 1 is prevented and a second position of rotation in which the door is free to close. The securing means and the latching means are formed integrally of a plastics material. The rotation of the latching means is effected via a thin portion formed between the latching means and the securing means.

5 Claims, 4 Drawing Figures

DEVICE FOR LATCHING A DOOR IN A PRE-DETERMINED POSITION OR ROTATION

FIELD OF THE PRESENT INVENTION

The present invention relates to a device for latching a door in a pre-determined position of rotation relative to a frame-structure to which the door is mounted. The device according to the invention shall be securely joined to the door itself.

BRIEF DESCRIPTION OF THE PRIOR ART

Device for latching a door in a pre-determined position of rotation are known to the art, said devices comprising elastic means which are inserted in the hinges between the door and the door frame. Such a device prevents the door from adopting a closed position, which eliminates clamping damage when the door is pivoted towards its closed position.

One disadvantage with such devices is that they are difficult to remove when it is required temporarily to close the door. In turn, this has meant that when the door is again opened, the efforts required to remount the device on to the door are so great that it has been found in practice that the device has not been applied to the hinges.

It is also known to latch a door in a fully open position, by providing the door with a hook which co-acts with an eye mounted on the wall of the frame structure. It is known that the operation of inserting the hook in the eye is a simple operation, but this operation is neverless sufficiently troublesome for it to be ignorated.

OBJECTS OF THE PRESENT INVENTION

An object of the present invention is to provide a device which, in a simple manner, can be adjusted to a first position of rotation in which the door is latched, and which device can readily be adjusted to a second position of rotation, in which the door is free to move. The device is always secured to the door and the device is adjusted to obtain the first and the second position of rotation by means of a simple manual manipulation.

The present invention relates to a device which can well be used in a manner mentioned above, but in which the device also functions as a door-stop, which per se implies a combination of previously known two devices which are completely different from each other.

MAIN FEATURES OF THE PRESENT INVENTION

The characterising features of the device according to the invention are the fact that the latching means extends from the securing means in the form of a horizontally or substantially horizontally extending portion. The securing means and the latching means are pivotally arranged relative to each other and exhibit locking means, which are adapted to co-act with each other so that the latching means is able to adopt one of two position of rotation relative to the securing means. A first position of rotation in which closing of the door 1 is prevented and a second position of rotation in which the door is free to close. The securing means and the latching means are formed integrally of a plastics material. The rotation of the latching means is effected via a portion formed between the latching means and the securing means.

BRIEF DESCRIPTION OF THE ATTACHED DRAWINGS

An embodiment of the invention disclosing the significant features thereof will now be more clearly described with reference to the accompanying drawing in which FIG. 1 shows the device mounted to an open door, which door is hinged to a frame associated therewith.

DESCRIPTION OF A PREFERRED EMBODIMENT

Figure 1:
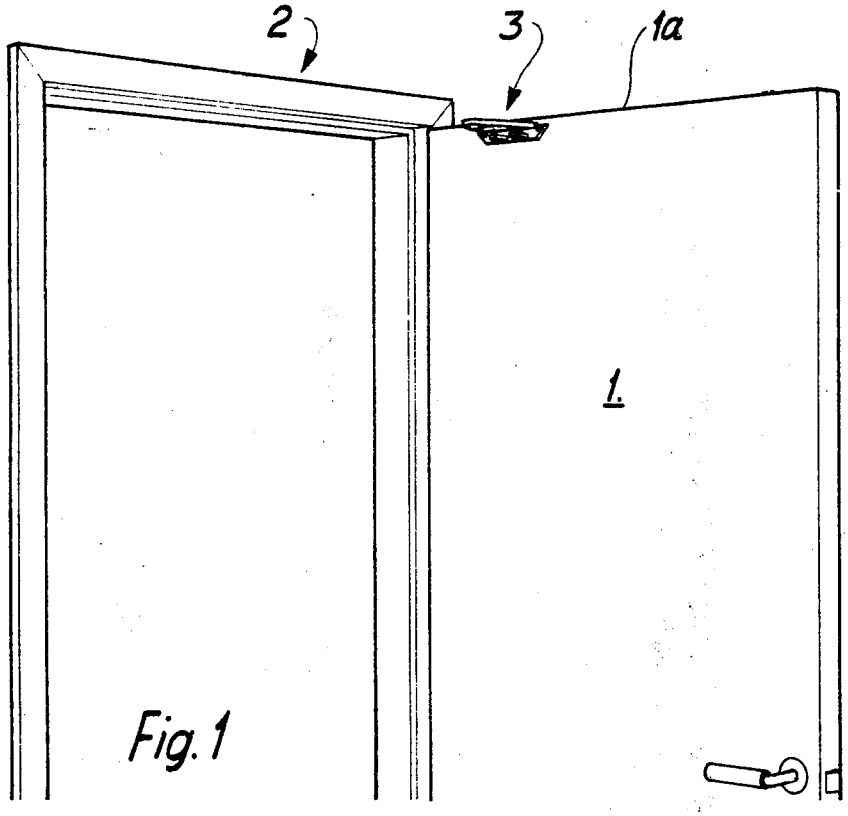

In FIG. 1 there is shown a device according to the invention for latching a door 1 in a pre-determined position of rotation relative to a door frame 2. The device according to the invention is referenced 3 and is secured to the door 1 in the manner shown in FIG. 1. The device 3 exhibits a securing means 31 which is attached to the door by screws 32, preferably adjacent the upper horizontal edge surface 1*a* of the door, and a latching means 33 which is secured to the securing means via a thin portion 34.

The latching means 33 has the form of a horizontally extending portion or a substantially horizontally extending portion, and the securing means 31 and the latching means 33 are pivotally arranged relative to each other via the thin portion 34. The securing means 33 exhibits locking means which are capable of co-operating with the latching means, as more clearly described hereinafter, so as to permit the latching means 33 to adopt one of two positions of rotation relative ot the securing means 31. In the first position of rotation, the door is latched, this position being shown in full lines in FIG. 2, while in the second position of rotation the door 1 is free to move, this latter position being shown in FIG. 2 in dash lines.

Figure 2:
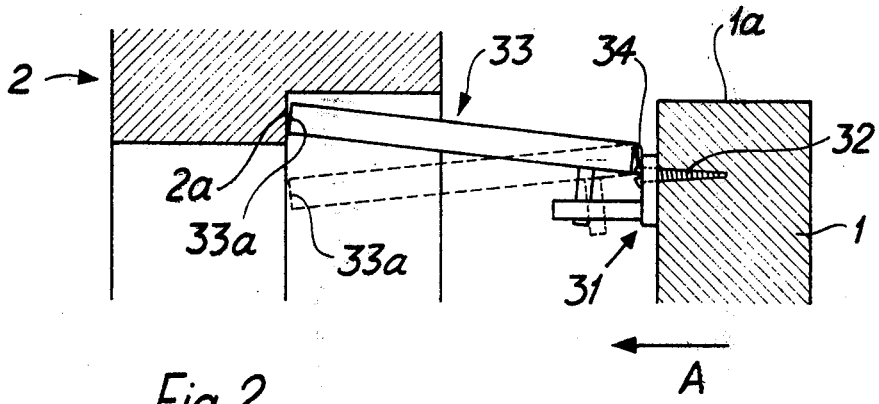
FIG. 2 shows the device according to the invention in side view occupying a first position of rotation shown in full lines and a second position of rotation shown in dash lines.

As will be seen from FIG. 2, the end 33*a* of the latching means 33 remote from the door 1 buts an edge 2*a* formed on the frame 2. In the second position of rotation, shown in dash lines, the end 33*a* of the latching means 33 is shown to be located under the edge 2*a*, which means that the door 1 is free to move, since the securing means 31 is located beneath the edge 2*a*. As will be seen in FIG. 2, the means 31 is positioned immediately beneath the edge 2*a*. When closing the door 1, the door will be displaced towards the door frame 2 in the direction of arrow A.

Figure 3:
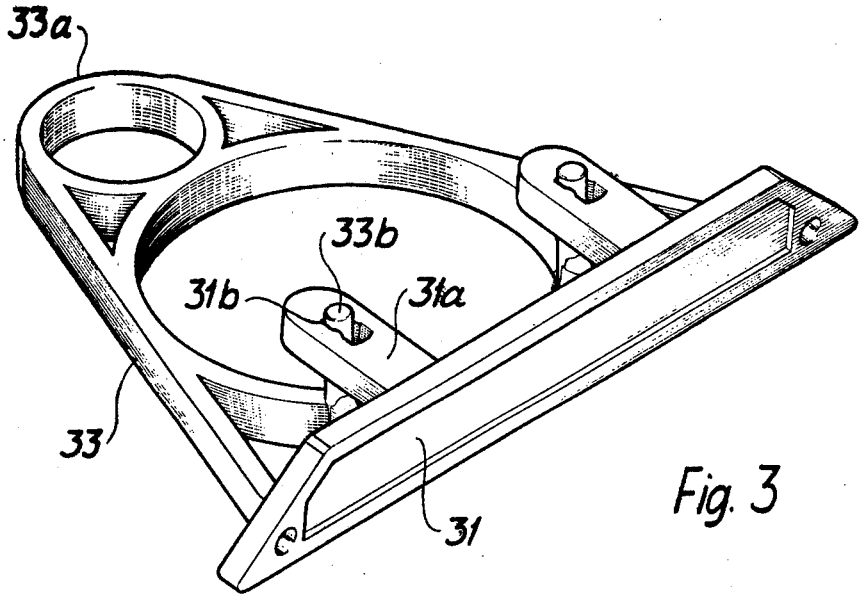
FIG. 3 is a perspective bottom plan view of the device for illustrative purposes.
Figure 4:
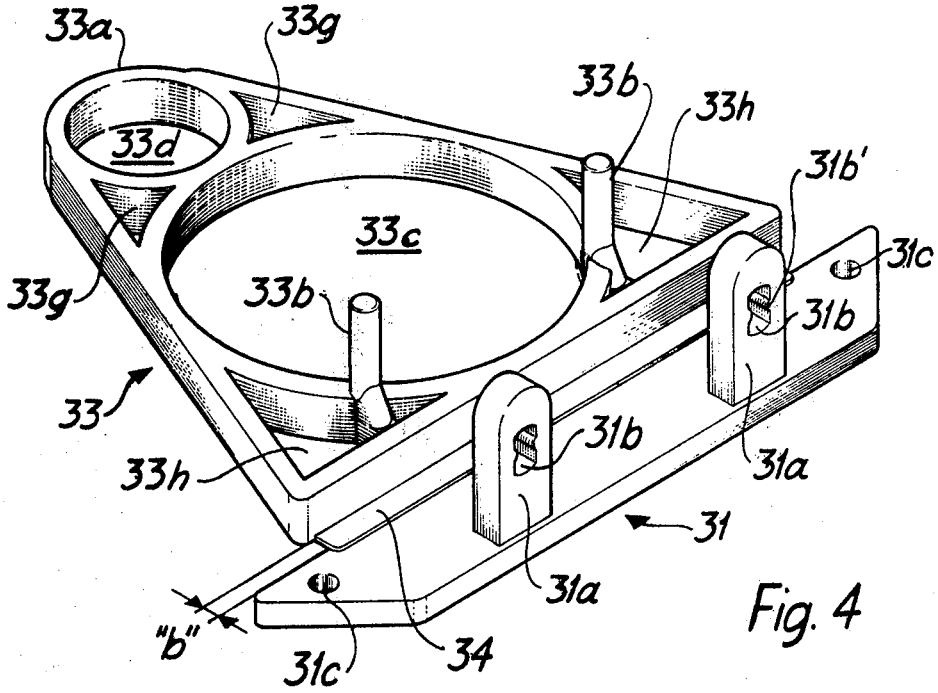
FIG. 4 shows the device manufactured in the form of a one-piece structure by means of a moulding tool.

FIGS. 3 and 4, illustrate the device according to the invention, the FIG. 4 in particular shows that the securing means 31 and the latching means 33 are integrally molded to form a one-piece unit. The arrangement as a whole may comprise a plastics material and rotation of the door is effected through a thin portion 34 formed between the means 31 and the means 33. As will be seen from FIG. 4, the means 31 and 33 are arranged in mutual spaced relationship, as a result of the thickness of the portion 34 said thickness being referenced "*b*". As a result of the provision of the thin portion 34, it is possible to rotate the means 31 and the means 33 to the position shown in FIG. 3 so that the locking means can be caused to co-act with each other.

The locking means capable of co-acting with the means 31 and 33 comprises one or more pegs associated with the latching means 33, there being shown two pegs 33*b* with the illustrated embodiment. These pegs 33*b* are intended to co-act with grooves 31*b* arranged in projections 31*a* extending from the securing means 31. The recesses 31*b* are of elongate configuration having centrally arranged constrictions 31*b* which means that the recess has the form of a figure eight. The contrictions 31*b*, however, shall be such that the peg 33*b* can be moved from one end of the respective grooves to the other with a snap-in action. FIG. 3 illustrates how the peg 33*b* co-act with the groove 31*b* in the first position of rotation of the door. When the means 33 adopts its other position of rotation, the peg 33*b* will adopt a position in the groove 31*b* so that peg 33*b* is located nearer the means 31.

In the illustrated embodiment, the latching means 33 is shown to be triangular in shape having a rounded-off point 33*a* and said latching means is provided with a plurality of recesses, of which 33*c* and 33*d* are circular in shape. Other recesses are provided, these recesses being designated 33*g* and 33*h* and are two in number and identical in shape. These recesses are formed in the means 33 in order to reduce its mechanical strength, so that said means 33 adopting the first position of rotation as shown in FIG. 2, is fractured when the door 1 is subjected to an excessively high force acting in the dirction of the arrow A.

FIG. 4 illustrates the arrangement immediately subsequent to its manufacture in a pressure moulding or casting tool, and FIG. 3 shows the arrangement in its operative state. The means 31 is provided with holes 31*c* through which screws 32 may be passed so as to secure the means 31 to the door 1.

The invention is not limited to the afore-described embodiment, but can be modified within the scope of the following claims. Thus, the means 31 may have a U-shaped configuration with the legs of the "U" occupying respective sides of the door blade.

What is claimed is:

1. A device comprising a securing means and a latching means for latching a door in a pre-determined position of rotation relative to a frame associated with said door when rotating the door in one direction, and with means securely attached to the door, in which the securing means is arranged to co-act with the door at its upper horizontal edge surface, wherein a. the latching means extends from the securing means in the form of a horizontally or substantially horizontally extending portion, b. that the securing means and the latching means are pivotally arranged relative to each other and exhibit locking means which are adapted to co-act with each other so that the latching means is able to adopt one of two position of rotation relative to the securing means, c. a first position of rotation in which rotation of the door is prevented and a second position of rotation in which the door is free to rotate, d. the securing means and the latching means are formed integrally, e. that said rotation of the latching means is effected via a thin portion formed between said latching means and said securing means.

2. A device according to claim 1, characterized in that the means are arranged at a distance from the thin portion.

3. A device according to claim 1, characterized in that the locking means comprises one or more pegs which are associated with the latching means and which can co-act with respective recesses in the securing means.

4. A device according to claim 3, characterized in that the recesses are of elongate construction having a centrally arranged constriction.

5. A device according to claim 1, characterized in that the latching means is of triangular shape having one point rounded off, and a plurality of recesses for reducing its mechanical strength.

* * * * *